United States Patent [19]

Blichasz et al.

[11] Patent Number: 4,588,249

[45] Date of Patent: May 13, 1986

[54] COAXIAL CABLE TAP CONNECTOR

[75] Inventors: Charles S. Blichasz; David H. Gutter; George W. Michael, III, all of Harrisburg, Pa.

[73] Assignee: AMP Incorporated, Harrisburg, Pa.

[21] Appl. No.: 439,240

[22] Filed: Nov. 3, 1982

[51] Int. Cl.[4] ..... H01R 4/24

[52] U.S. Cl. ..... 339/97 P; 339/177 R

[58] Field of Search ..... 339/97 R, 97 P, 98, 339/99 R, 177 R, 176 MP, 17 C

[56] References Cited

U.S. PATENT DOCUMENTS

| | | | |
|---|---|---|---|
| 2,694,182 | 11/1954 | Edlen et al. | 333/6 |
| 2,694,183 | 11/1954 | Edlen et al. | 339/97 P |
| 2,706,282 | 4/1955 | Dudra | 339/97 P |
| 2,805,399 | 9/1957 | Leeper | 339/97 P |
| 2,843,827 | 7/1958 | Blonder | 333/6 |
| 3,452,320 | 6/1969 | Kempf | 339/97 P |
| 3,951,490 | 4/1976 | Devendorf | 339/17 C |
| 3,989,333 | 11/1976 | Cauldwell | 339/17 C |
| 4,120,554 | 10/1978 | Bianchi et al. | 339/97 R |
| 4,437,722 | 3/1984 | Bianchi | 339/97 P |

*Primary Examiner*—Joseph H. McGlynn
*Attorney, Agent, or Firm*—Adrian J. LaRue

[57] ABSTRACT

A coaxial cable tap connector comprises a cable-engaging member having a channel therealong in which a section of a coaxial cable is to be disposed. Outer conductor contact members are located in the cable-engaging member within the channel on each side of a threaded hole, the contact members including post sections disposed within a printed circuit board guide slot of the cable-engaging member. A clamp-retaining member has a movable clamp member disposed therein and is slidably positioned onto the cable-engaging member, the clamp member having a channel for engaging the cable. A driving member is mounted on the clamp-retaining member and engages the clamp member thereby driving the clamp member into clamping engagement with the cable and clamping the cable between the clamp member and the cable-engaging member within the channels thereof. The clamping operation causes the outer conductor contact members to penetrate an outer jacket of the cable and make electrical connection with an outer conductor of the cable. A signal probe assembly is threadably positioned in the threaded hole causing a spring-biased signal probe member to rotatingly penetrate into the cable so that a contact section of the signal probe member makes electrical connection with the center conductor. A post section of the signal probe member is disposed within the printed circuit board guide slot so that it and the post sections of the outer conductor contact members can be electrically connected with electrical contacts on a printed circuit board of a transceiver member to be mounted onto the tap connector.

21 Claims, 8 Drawing Figures

54
14
52
46
44
46
16
10
58
44
56
48
40
26
32
12
24
20
40
110
26
43
22
38
32
42
43
66
60
100
108
76
18
64
78
80
68
104
106
116
102
114
116
112
114
118

10
54
14
12
46
44
40
16
44
112
22
38
110
48
112
100
108
120

14
50
54
52
10
16
44
40
22
20
26
32
34
70
24
32
34
26
106
60
12
108
112
30
28
28
112
43
78
64
62
18
30
43
68
102
102
42
104
100

COAXIAL CABLE TAP CONNECTOR

FIELD OF THE INVENTION

This invention relates to coaxial connectors and more particularly to coaxial cable tap connectors having a signal probe for penetrating into a coaxial cable and electrically connecting with a center conductor and electrical contacts that penetrate the coaxial cable and form electrical connection with an outer conductor thereof.

BACKGROUND OF THE INVENTION

A coaxial cable tap connector is disclosed in U.S. Pat. No. 4,120,554 which includes matable housing members each having a semicylindrical channel. When the housing members are secured together onto a coaxial cable, the semicylindrical channels coincide and outer conductor contacts penetrate the outer jacket of the coaxial cable and make electrical connection with the outer conductor of the coaxial cable. A spring-biased center conductor probe is driven so as to penetrate into the coaxial cable and make electrical connection with the center conductor. The probe does not rotate as it is being driven into connection with the center conductor, thus the electrical contact section of the probe is not cleaned as well as any debris being removed from the contact area between the contact section of the probe and the center conductor that may collect when the probe is being driven through the coaxial cable into electrical connection with the center conductor.

A coaxial cable tap is known that is easily applied onto a coaxial cable. It includes housing members having arcuate recesses engaging the cable. When the housing members are secured together with the cable disposed in the recesses, ground probes as integral parts of one or both of the housing members located in the recess or recesses penetrate through the outer jacket of the coaxial cable and make electrical connection with the outer conductor. A signal probe is threaded into a threaded hole of one of the housing members and is driven into the cable until its contact section is electrically connected with the center conductor. However, no spring is associated with the signal probe, thus the center conductor may eventually drift away from the probe resulting in an open connection. The connection between the probe and the center conductor may relax over time thereby causing a high resistance connection impairing the transfer of signal information thereacross.

SUMMARY OF THE INVENTION

According to the present invention, a coaxial cable tap connector comprises a cable-engaging member having a channel therealong in which a section of a coaxial cable is to be disposed. Outer conductor contact members are located in the cable-engaging member within the channel on each side of a threaded hole, the contact members including post sections disposed within a printed circuit board guide slot of the cable-engaging member. A clamp-retaining member has a movable clamp member disposed therein and is slidably positioned onto the cable-engaging member, the clamp member having a channel for engaging the cable. A driving member is mounted on the clamp-retaining member and engages the clamp member thereby driving the clamp member into clamping engagement with the cable and clamping the cable between the clamp member and the cable-engaging member within the channels thereof. The clamping operation causes the outer conductor contact members to penetrate an outer jacket of the cable and make electrical connection with an outer conductor of the cable. A signal probe assembly is threadably positioned in the threaded hole causing a spring-biased signal probe contact member to rotatingly be driven into the cable so that a contact section of the signal probe contact member makes electrical connection with the center conductor. A post section of the signal probe contact member is disposed within the printed circuit board guide slot so that it and the post sections of the outer conductor contact members can be electrically connected with electrical contacts on a printed circuit board of a transceiver member to be mounted onto the tap connector.

According to another aspect of the present invention, the contact section and part of the insulation covering the signal probe contact member have self-tapping threads enabling the signal probe member to thread its way into the cable as the signal probe assembly is being threaded into position in the threaded hole of the cable-engaging member so that the contact section is electrically connected to the center conductor and the area along which the self-tapping threads form is cleaned.

DETAILED DESCRIPTION OF THE INVENTION

Figure 1:
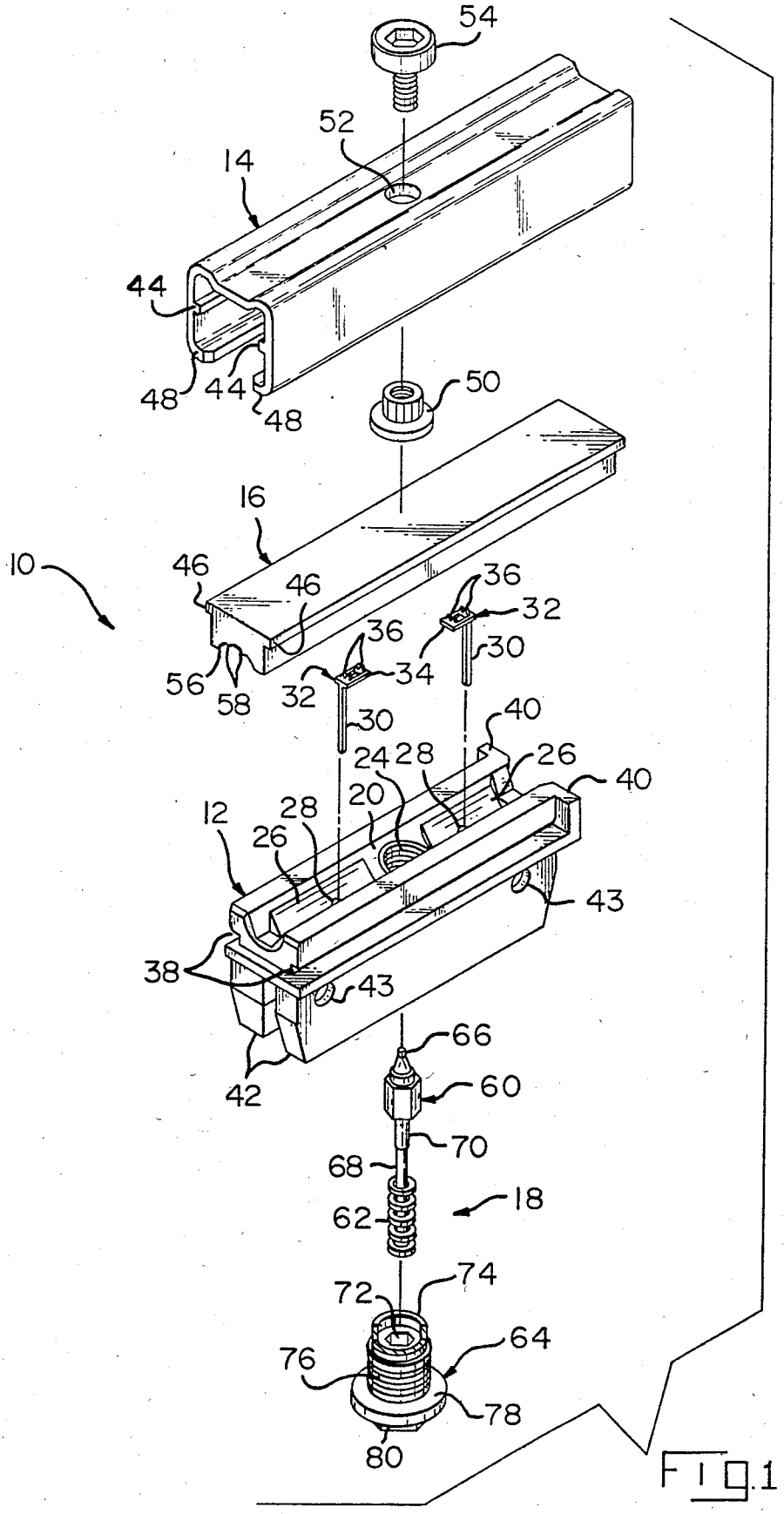
FIG. 1 is an exploded and perspective view of the parts of a coaxial cable tap connector.

A coaxial cable tap connector 10 as shown in FIGS. 1 through 4 includes a cable-engaging member 12, a clamp-retaining member 14, a clamp member 16, and a signal probe assembly 18.

Figure 4:
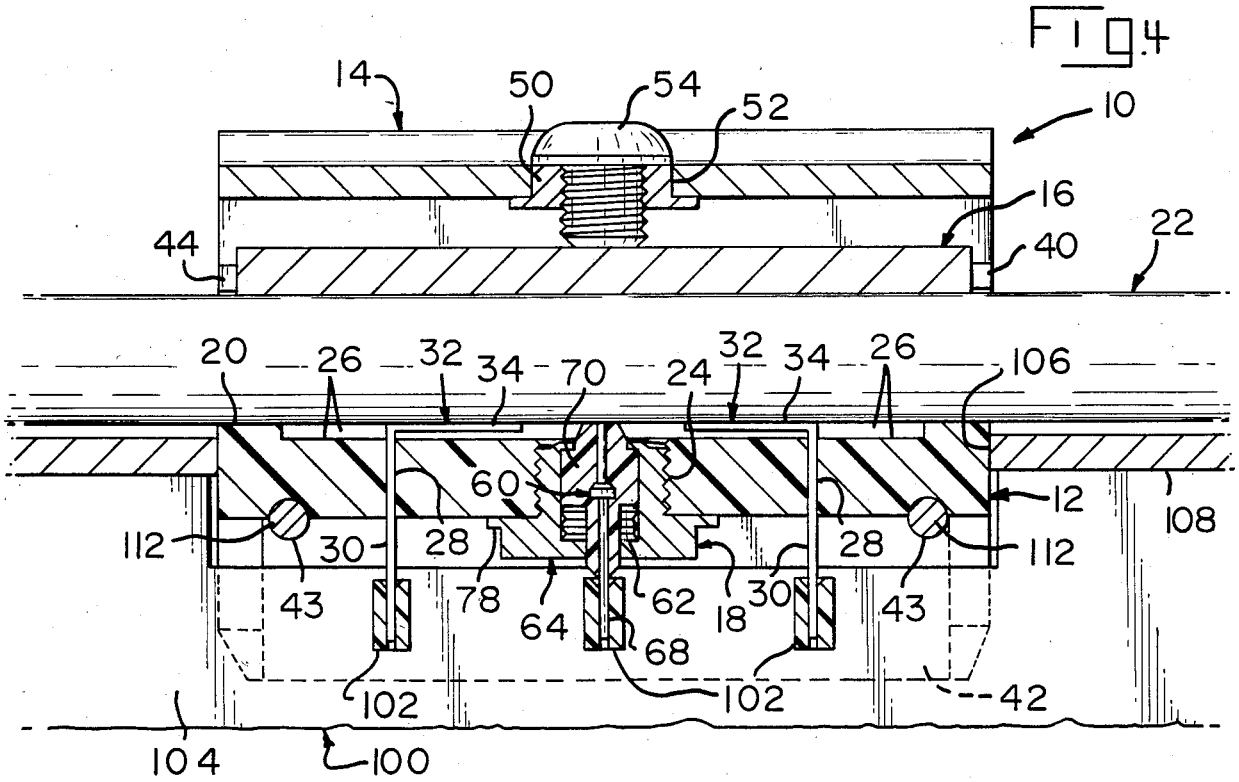
FIG. 4 is a cross-sectional view of FIG. 3.
Figure 6:
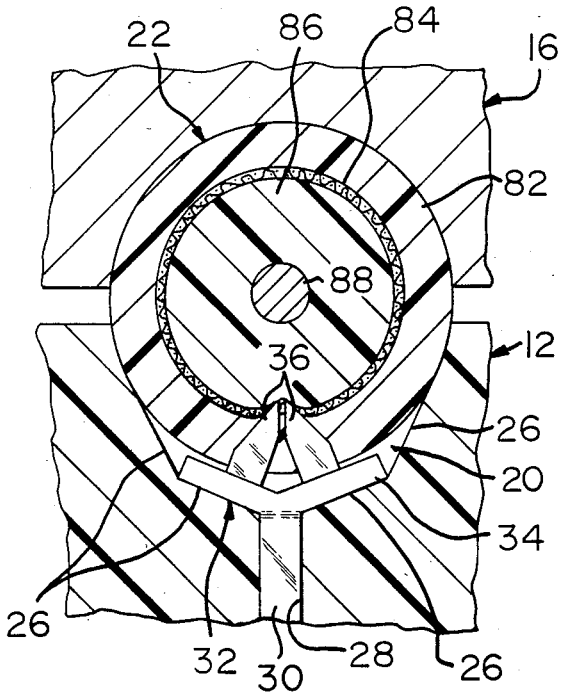
FIG. 6 is a cross-sectional view through the tap connector showing the outer conductor contact member connected to the outer conductor.

Cable-engaging member 12 is molded from a suitable plastic material that is preferably glass-filled and has a channel 20 extending therealong in which a section of coaxial cable 22 is to be disposed. A threaded hole 24 extends through member 12 and a series of intersecting flat surfaces 26 are located in channel 20 on each side of threaded hole 24. A hole 28 extends through member 12 and communicates with channel 20 via the bottom flat surfaces of each of the series of intersecting flat surfaces 26 as best shown in FIGS. 4 and 6. Post sections 30 of outer conductor contact members 32 are disposed in respective holes 28 and they are frictionally secured therein. Bases 34 of contact members 32 have stamped therefrom tines 36. The outer ends of tines 36 are pointed and bases 34 in their normal condition are planar and extend across the flat surfaces 26 adjacent the bottom flat surface containing holes 28. Recesses 38 are located in opposing sides of cable-engaging member 12 and they terminate at stop members 40. Spaced projections 42 extend outwardly from the bottom of cable-engaging member 12 and form a printed circuit board guide slot as well as protecting the post sections of the contact members.

Figure 2:
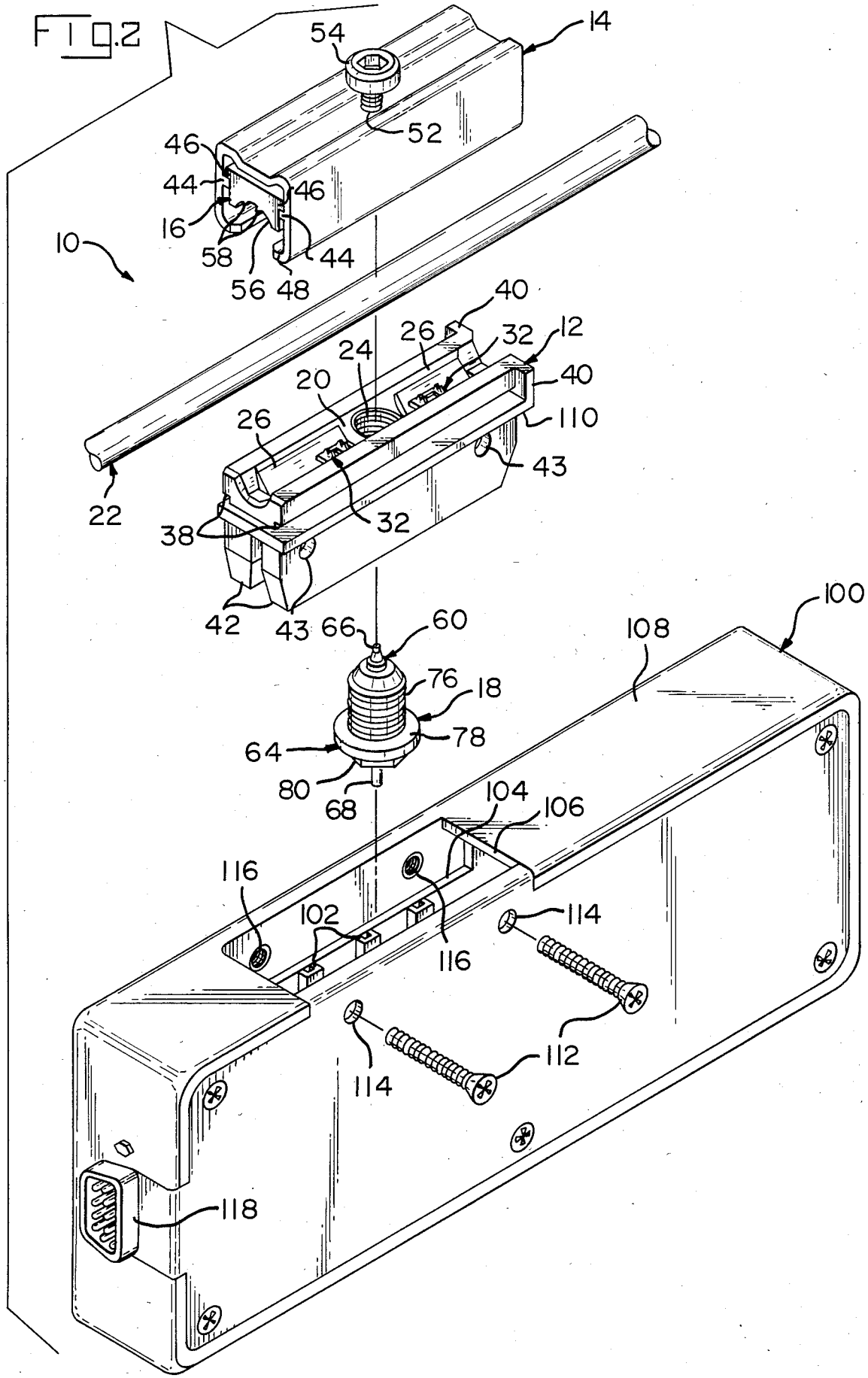
FIG. 2 is a view similar to FIG. 1 with parts in an assembled condition prior to connection onto a section of a coaxial cable and a transceiver exploded therefrom.
Figure 3:
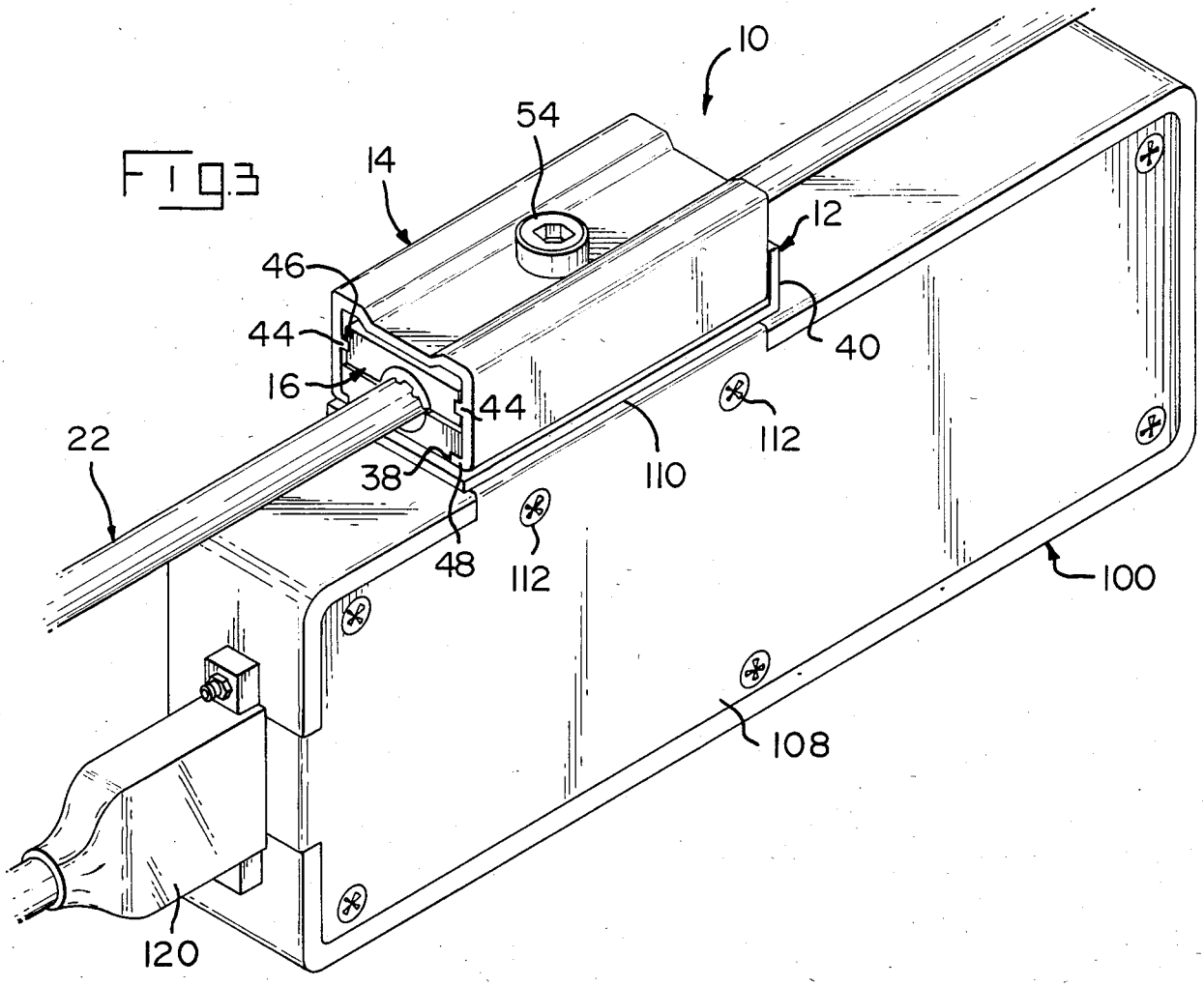
FIG. 3 is a perspective view of the tap connector connected to the cable and to which is mounted the transceiver.

Clamp-retaining member 14 is extruded from a suitable metal and has projection 44 extending along the inside surfaces of the sides thereof which are engaged by projections 46 of clamp member 16 when clamp member 16 is disposed within clamp-retaining member 14 as shown in FIG. 2. The sides of clamp-retaining member 14 terminate into inwardly-directed sections 48 which cooperate with recesses 38 in cable-engaging member 12 to mount clamp-retaining member 14 onto cable-engaging member 12 when these members are to be secured onto a section of coaxial cable 22. A nut member 50 is press fitted into hole 52 of clamp-retaining member 14 with bolt 54 threadably mounted in nut member 50 so as to move clamp member 16 relative to clamp-retaining member 14. Clamp member 16 has a channel 56 along which projections 58 extend.

Signal probe assembly 18 includes a signal probe contact member 60, Belleville spring washers 62, and a probe retainer bolt 64. Signal probe contact member 60 includes a conical contact section 66 from which extends a post section 68. Dielectric material 70 is molded onto post section 68 from conical contact section 66 to a position spaced from the end of post section 68 so that a part of post section 68 is exposed. Dielectric material 70 from conical contact section 66 downwardly has an upper cylindrical section, the outside diameter of which is the same as the base of contact section 66, a conical section, a lower cylindrical section, a hexagonal section, and a bottom cylindrical section along which spring washers 62 are disposed as shown in FIGS. 4 and 5.

Probe retainer bolt has a bore 72, the upper end of which is of hexagonal configuration in which the hexagonal section of dielectric material 70 is disposed, and a cylindrical section through which the bottom cylindrical section of dielectric material 70 extends. After signal probe contact member 60 has been inserted in bore 72 of retainer bolt 64 with the hexagonal section of dielectric material 70 disposed in the hexagonal part of bore 72 with spring washers 62 disposed on the lower cylindrical section of dielectric material 70 in engagement with the bottom of the hexagonal part and this lower cylindrical section of dielectric material 70 extending through the cylindrical section of bore 72 as shown in FIG. 5, top annular section 74 of bolt 64 is rolled inwardly into engagement with the hexagonal section of dielectric material 70 thereby securing signal probe contact member 60 in position in bore 72 of bolt 64 and under spring pressure of spring washers 62 as shown in FIG. 5. Threaded section 76 of bolt 64 is threadably matable with threaded hole 24 of cable-engaging member 12 with flange 78 serving as a bottoming member limiting the movement of signal probe assembly 18 into member 12 and hexagonal section 80 being engaged by a wrench to move threaded section 76 along threaded hole 24.

In operation, cable-engaging member 12 is positioned against cable 22 so that a section thereof is positioned within channel 20. Clamp-retaining member 14 with clamp member 16 therein is moved transverse to the axis of cable 22 to the left of cable-engaging member 12 when viewing FIG. 2 and is then moved axially along cable 22 with inwardly-directed sections 48 sliding along recesses 38 until member 14 engages stop members 40. Bolt 54 is then moved in nut member 50 thereby driving clamp member 16 into engagement with cable 22 causing projections 58 to bite into outer jacket 82 of cable 22 and as cable 22 is forced into channel 20 of cable-engaging member 12, tines 36 of outer conductor contact members 32 penetrate through outer jacket 82 and electrically connect with outer conductor 84 of cable 22. As shown in FIG. 6, as cable 22 is forced into channel 20 of cable-engaging member 12, bases 34 of contact members 32 are bent into engagement with flat surfaces 26 adjacent the bottom-most flat surface and this causes tines 36 to be directed toward each other thereby capturing part of outer conductor 84 therebetween as well as establishing a wiping contact between tines 36 and outer conductor 84 during the termination therebetween which results in an excellent mechanical and electrical connection. Such action is disclosed in U.S. Pat. No. 4,120,554 which is incorporated herein by reference. With cable 22 now properly secured in channel 20 of cable-engaging member 12 via clamp member 16, outer conductor 84 is now properly terminated by outer conductor contact members 32.

Figure 5:
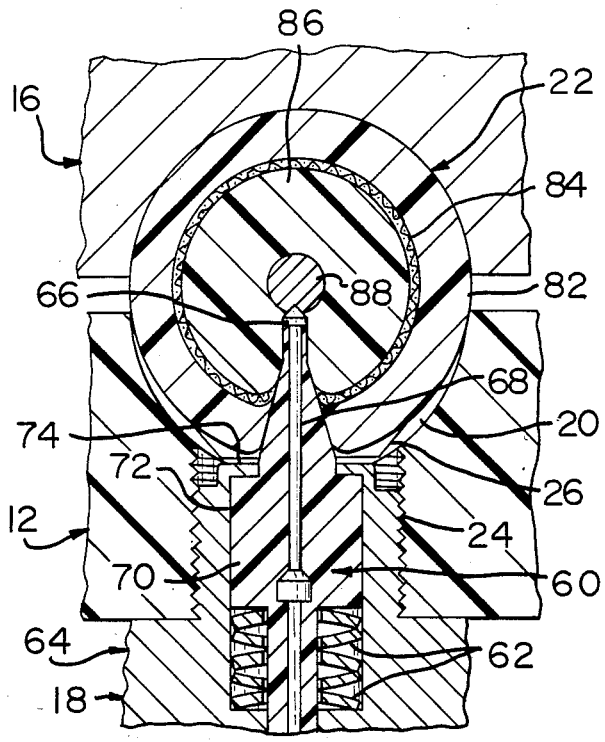
FIG. 5 is a cross-sectional view through the tap connector at the signal probe assembly showing the signal probe contact member connected to the center conductor.

Signal probe assembly 18 is now positioned in member 12 by threaded section 76 threadably engaging threaded hole 24 and as bolt 64 is moved inwardly, signal probe contact member 60 penetrates through outer jacket 82, outer conductor 84, into insulation sheath 86 of cable 22 with conical contact section 66 embedding into center conductor 88 as shown in FIG. 5. As signal probe contact member 60 is penetrating through outer jacket 82, outer conductor 84, into insulation sheath 86 and into center conductor 88 via the rotation of signal probe assembly 18 as it is threadably moved along threaded hole 24 by threaded section 76, conical contact section 66 is cleaned so that an excellent mechanical and electrical connection is formed between center conductor 88 and contact section 66, and dielectric material 70 prevents any shorting between outer conductor 84, post section 68, conical section 66, and center conductor 88. An excellent mechanical and electrical connection is also effected between center conductor 88 and contact section 66 due to the balancing of the spring forces generated by the signal probe assembly 18 against the tensile spring characteristics of center conductor 88.

Figure 7:
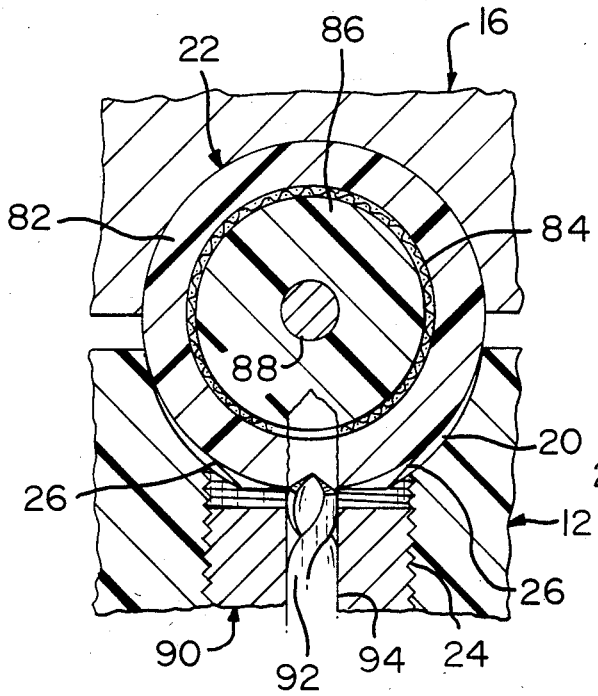
FIG. 7 is a cross-sectional view through the tap connector showing a drill guide and a drill bit having drilled a hole in the cable.

If desired, a drill guide 90 can be threadably positioned in threaded hole 24 as shown in FIG. 7 so that drill member 92 can be guided by hole 94 in drill guide 90 to drill a hole through outer jacket 82, outer conductor 84, and partway into insulation sheath 86. Drill guide 90 is then removed from member 12 and signal probe assembly 18 is threadably positioned in threaded hole 24 with conical contact section 66 electrically connected with center conductor 88 as shown in FIG. 5. The practice of drilling a hole in cable 22 prior to signal probe assembly 18 being positioned in threaded hole 24 is generally followed if damage may be done to signal probe contact member 60 as it is being driven into cable 22 by bolt 64 or cable 22 has double layers of braid and conductive sheaths for the outer conductor which would make it difficult for signal probe contact member 60 to penetrate through the double layers.

Figure 8:
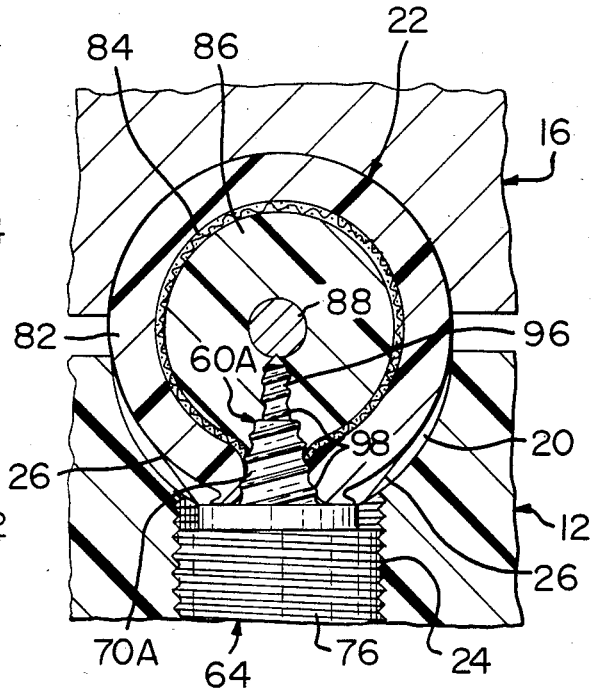
FIG. 8 is a cross-sectional view through the tap connector showing an alternative signal probe contact member.

FIG. 8 illustrates an alternative embodiment of signal probe contact member 60A whereby a contact section 96 and the conical section of dielectric material 70A have threads 98 thereon which are at a different pitch than the threads on threaded section 76 thereby enabling contact section 96 and the conical section of dielectric material 70A to readily penetrate through outer jacket 82, outer conductor 84, into insulation sheath 86, and into electrical connection with center conductor 88 while bolt 64 is being threadably moved along threaded hole 24. Threads 98 are of a different pitch than the threads on threaded section 76 which enables threads 98 to self-tap their way into cable 22 while cleaning the tapped area during this self-tapping operation. This also assures that the outer conductor will not short the connection because the threads on the conical section of dielectric material 70A forces the outer conductor away from center conductor 22.

After tap connector 10 has been terminated to the outer and center conductors of cable 22, transceiver 100 of conventional construction can be electrically connected to connector 10 via electrical connectors 102 on printed circuit transceiver board 104 mating with post sections 30 and 68 of contact members 32 and 60, board 104 being guided into position by the slot between projections 42 as projections 42 extend into opening 106, housing 108 carrying board 104. Housing 108 abuts against surface 110 of cable-engaging member 12 and is secured to member 12 via screws 112 extending through holes 114 in housing 108, holes 43 in member 12, and threadably engaging threaded members 116 in housing 108. A gasket can be interposed between surface 110 and housing 108 to form a seal therebetween. An I/O connector 118 is mounted in housing 108 and electrically connected to the electronic circuitry on board 104 so that electrical connector 120 can be connected thereto to process input and output signals from and to electronic equipment via cable 22, connector 10, transceiver 100, and connectors 118, 120. A dust shield (not shown) can be sealingly secured onto connector 10 in the same manner as transceiver 100 to protect connector 10 when not in use.

We claim:

1. A coaxial cable tap connector of the type for electrical connection to the outer and center conductors of a coaxial cable which comprises first and second matable members securable together and each having a channel for engagement with the cable, an outer conductor contact member for penetration through an outer jacket of the cable for electrical connection with an outer conductor of the cable when the matable members are secured together, and a spring-biased signal probe contact member connector for electrical connection with a center conductor of the cable, characterized in that, the second matable member contains a clamp member having said channel therealong, a member in said second matable member moves said clamp member into clamping engagement with the cable causing the outer conductor contact member to penetrate through the outer jacket and electrically connect with the outer conductor;

said spring-biased signal probe contact member is part of a signal probe assembly including a threaded bolt carrying said spring-biased signal probe contact member, said threaded bolt being matable with a threaded hole in one of said matable members to rotatably drive said spring-biased signal probe contact member through the outer jacket and outer conductor, into an insulation sheath and into electrical connection with the center conductor.

2. A coaxial cable tap connector as set forth in claim 1, characterized in that said outer conductor contact member and said probe contact member have post sections disposed between spaced projections of said first matable member, said spaced projections defining an area in which a section of a printed circuit board is disposed so that said post sections electrically connect with electrical connectors on the printed circuit board.

3. A coaxial cable tap connector as set forth in claim 1, characterized in that said clamp member has projections along said channel for biting into the outer jacket when said clamp member is moved into clamping engagement with the cable.

4. A coaxial cable tap connector as set forth in claim 1, characterized in that said first matable member includes recesses along which inwardly-directed sections of said second matable member moves to secure said matable members together.

5. A coaxial cable tap connector as set forth in claim 4, characterized in that said first matable member has stop members against which said second matable member engages when said matable members are secured together.

6. A coaxial cable tap connector as set forth in claim 1, characterized in that said threaded bolt has a bore with part of the bore having a hexagonal configuration and another part of the bore having a cylindrical configuration, said signal probe contact member having a contact section and a post section with dielectric material covering said post section from said contact section to a position spaced from a free end thereof, said dielectric material having a hexagonal section disposed in the hexagonal part of said bore and a cylindrical section disposed along the cylindrical part, spring members extending along said cylindrical section between the hexagonal section and the bottom of the cylindrical part, and a top section of said threaded bolt being rolled onto the hexagonal part securing said signal probe contact member in said bore.

7. A coaxial cable tap connector as set forth in claim 6, characterized in that said contact section of said signal probe contact member has a conical shape and said dielectric material from said contact section to said hexagonal section includes an upper cylindrical section having an outside diameter the same as the diameter of said conical contact section and a conical section.

8. A coaxial cable tap connector as set forth in claim 6, characterized in that said dielectric material from said contact section of said signal probe contact member to said hexagonal section has a conical shape and said contact section and said conical shape dielectric material have threads thereon.

9. A coaxial cable tap connector for connection to a center conductor and an outer conductor of a coaxial cable, comprising:

cable-engaging means for engaging a section of the coaxial cable and having outer conductor contact means disposed therein;

clamp-retaining means having clamp means therein;

means on said cable-engaging means and said clamp-engaging means for securing said cable-engaging means and said clamp-retaining means onto the section of the coaxial cable;

means provided by said clamp-retaining means for moving said clamp means into clamping engagement with the section of the coaxial cable and causing said outer conductor contact means to penetrate through an outer jacket of the coaxial cable and make electrical connection with the outer conductor; and signal probe assembly means adapted to be rotatably secured in said cable-engaging means and including spring-biased signal probe contact means that extends through the outer jacket, outer conductor, into an insulation sheath, and into electrical connection with the center conductor during the rotational securing of said signal probe assembly means in said cable-engaging means.

10. A coaxial cable tap connector as set forth in claim 9 wherein said securing means includes recesses in said cable-engaging means in which inwardly-directed sections of said clamp-retaining means are to be disposed.

11. A coaxial cable tap connector as set forth in claim 9 wherein said clamp means has a channel in which are disposed projections for biting into the outer jacket when said clamp means is clampingly engaged with the section of the coaxial cable.

12. A coaxial cable tap connector as set forth in claim 9 wherein said outer conductor contact means and said signal probe contact means include post means, said cable-engaging means including spaced projection means with said post means disposed therebetween.

13. A coaxial cable tap connector as set forth in claim 9 wherein said signal probe assembly means includes bolt means having bore means and a threaded section for threadable engagement with a threaded hole in said cable-engaging means, said bore means having a hexagonal part and a cylindrical part, said signal probe contact means having a contact section and a post section, dielectric material extending from said contact section to a position spaced from an end of said post section, a hexagonal section of said dielectric material disposed in said hexagonal part and a cylindrical section of said dielectric material extending along said cylindrical part, spring means extending along said cylindrical section between said cylindrical section and a bottom of said hexagonal part, and an annular section of said bolt means being bent into engagement with said hexagonal section.

14. A coaxial cable tap connector as set forth in claim 13 wherein said contact section is conical, said dielectric material has an upper cylindrical section and a conical section, said cylindrical section having an outer diameter the same as the diameter of said conical contact section.

15. A coaxial cable tap connector as set forth in claim 13 wherein said dielectric material has a conical section, said contact section and said conical section have thread means thereon.

16. A coaxial connector for connecting a center conductor and an outer conductor of a coaxial cable to respective signal and ground conductive paths of a printed circuit board, comprising:

first and second cable-engaging means for engaging a section of the coaxial cable;

outer conductor contact means provided by one of said first and second cable-engaging means for electrical connection with the outer conductor of the coaxial cable;

means securing said first and second cable-engaging means onto the section of the coaxial cable so that said outer conductor contact means can be electrically connected with the outer conductor;

center conductor contact means provided by one of the first and second cable-engaging means for electrical connection with the center conductor of the coaxial cable;

electrical terminal means as part of said center conductor contact means and said outer conductor contact means;

the one of said first and second cable-engaging means having an area along which said electrical terminal means extend and along which a section of the printed circuit board is to be disposed so that the signal and ground conductive paths on the printed circuit board are electrically connected with the respective electrical terminal means of said center conductor contact means and said outer conductor contact means.

17. A coaxial connector as set forth in claim 16, wherein said securing means includes a clamp means movably disposed in the other of said cable-engaging means, and means provided by said other cable-engaging means for moving said clamp means into clamping engagement with the coaxial cable.

18. A coaxial connector as set forth in claim 16, wherein said center contact means includes a threaded bolt carrying a center contact member, said threaded bolt being matable with a threaded hole in the one cable-engaging means to rotatably drive the center contact member through an outer jacket and the outer conductor, into an insulation sheath of the coaxial cable and into electrical connection with the center conductor, said center contact member having dielectric means thereon in the vicinity of the outer conductor to insulate the center contact member from the outer conductor.

19. A coaxial connector as set forth in claim 18, wherein spring means is in association with said center contact member to constantly bias said center contact member in electrical connection with the center conductor.

20. A coaxial connector as set forth in claim 18, wherein said center contact member has a section extending outwardly from said bolt and said dielectric means covers said section except for an exposed contact section which is to connect with the center conductor, said exposed contact section and said dielectric means covering said section having thread means thereon enabling said center contact means to self tap into the coaxial cable.

21. A coaxial connector as set forth in claim 18, wherein said center contact member has a section extending outwardly from said bolt and said dielectric means covers said section except for an exposed contact section of conical configuration which is to connect with the center conductor, said dielectric means covering said section having a first part and a second part, said first part having a diameter coincident with the diameter of a base of said conical contact section and said second part having a tapered configuration.

* * * * *